US006389966B2

(12) United States Patent
Bachmeir et al.

(10) Patent No.: US 6,389,966 B2
(45) **Date of Patent: *May 21, 2002**

(54) SMOOTHING ROLLER IN A PRINTING UNIT OF A ROTARY PRINTING MACHINE

(75) Inventors: Xaver Bachmeir, Affing-Haunswies; Wolfram Fischer, Neusäss; Bernhard Feller, Friedberg, all of (DE)

(73) Assignee: Man Roland Druckmaschinen AG, Offenbach am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/123,887

(22) Filed: Jul. 28, 1998

(30) Foreign Application Priority Data

Jul. 29, 1997 (DE) ..... 197 32 497

(51) Int. Cl.[7] ..... B41F 31/00
(52) U.S. Cl. ..... 101/349.1; 101/422
(58) Field of Search ..... 101/348, 349.1, 101/352.11, 422, 205–208, 350.1, 351.5, 148

(56) References Cited

U.S. PATENT DOCUMENTS

| | | | | | |
|---|---|---|---|---|---|
| 1,755,278 | A | * | 4/1930 | Strain | |
| 3,146,706 | A | * | 9/1964 | Tonkin et al. | 101/148 |
| 3,168,037 | A | * | 2/1965 | Dahlgren | 101/148 |
| 3,504,626 | A | * | 4/1970 | Worthington | 101/148 |
| 3,508,489 | A | * | 4/1970 | Norton | 101/148 |
| 3,673,959 | A | * | 7/1972 | Jezuit et al. | 101/148 |
| 3,688,694 | A | * | 9/1972 | Preuss et al. | 101/148 |
| 3,698,312 | A | * | 10/1972 | Muller | 101/142 |
| 4,019,437 | A | * | 4/1977 | Crystal | 101/466 |
| 4,308,799 | A | * | 1/1982 | Kitagawa et al. | 101/457 |
| 4,522,123 | A | * | 6/1985 | Matsumoto | 101/349 |
| 4,691,630 | A | * | 9/1987 | Asano | 101/212 |
| 4,777,877 | A | * | 10/1988 | Lemaster | 101/426 |
| 4,903,599 | A | * | 2/1990 | Kubler et al. | 101/450.1 |
| 5,061,598 | A | * | 10/1991 | Abe et al. | 430/272 |
| 5,355,796 | A | * | 10/1994 | Kobler et al. | 101/148 |
| 5,380,620 | A | * | 1/1995 | Namiki et al. | 430/257 |
| 5,471,926 | A | * | 12/1995 | Junghans et al. | 101/148 |
| 5,676,053 | A | * | 10/1997 | Schafer | 101/141 |
| 5,881,644 | A | * | 3/1999 | Miyaguchi et al. | 101/450.1 |

FOREIGN PATENT DOCUMENTS

| | | | |
|---|---|---|---|
| DE | 657165 | 2/1938 | |
| DE | 32 32 780 A1 | 5/1983 | B41F/7/20 |
| DE | 33 24 382 C2 | 1/1984 | B41F/31/00 |
| DE | 39 06 647 | 10/1989 | B41F/31/06 |
| DE | 44 24 891 A1 | 1/1996 | B41M/1/06 |
| DE | 44 24 913 A1 | 2/1996 | B41F/31/26 |
| DE | 44 24 920 A1 | 2/1996 | B41F/31/00 |
| DE | 196 25 362 | 1/1998 | B41F/31/06 |
| DE | 197 31 003 | 1/1999 | B41F/31/04 |
| GB | 2 327 380 | 1/1999 | B41F/31/00 |
| JP | 01-105741 | 4/1989 | B41F/7/36 |
| JP | 04-197750 | 7/1992 | B41F/31/02 |

* cited by examiner

*Primary Examiner*—Eugene Eickholt
(74) *Attorney, Agent, or Firm*—Cohen, Pontani, Lieberman & Pavane

(57) ABSTRACT

The present invention provides a smoothing roller for a printing unit of a rotary printing machine. The smoothing roller is applied to the form cylinder downstream of the ink applicator roller in relation to the direction of rotation of the form cylinder or onto the ink applicator roller itself. The smoothing roller smooths the ink film on the form cylinder or on the ink applicator roller. The outer surface of the smoothing roller has an ink-repelling characteristic. The ink-repelling characteristic is effected by a liquid ink-repelling material such as a separating agent or a dampening medium that is applied to the outer surface of the smoothing roller or by an outer surface of the smoothing roller comprising an ink-repelling material. The two measures for effecting the ink-repellant characteristic of the smoothing roller may also be provided in combination with one another.

7 Claims, 4 Drawing Sheets

SMOOTHING ROLLER IN A PRINTING UNIT OF A ROTARY PRINTING MACHINE

BACKGROUND OF THE INVENTION

1. Field of the Invention

The invention relates to a smoothing roller in a printing unit of a rotary printing machine.

2. Description of the Related Art

Reference DE 44 24 913 A1 discloses a short inking unit for the inking of a form cylinder for dry offset printing. The short inking unit has an ink transfer roller and an ink applicator roller. The ink transfer roller is designed as a screen roller. Between the depressions on the outer surface of the screen roller there are webs which have high affinity to a separating agent, for example silicone oil. For this purpose, the hard-ceramic material of the ink transfer roller is impregnated with silicone oil, or silicone rubber or fluorosilicone rubber is embedded into the hard-ceramic material. The depressions are lined with an ink-friendly coating repelling the separating agent. The design of the ink transfer roller is intended to avoid ink transfer difficulties when using inks mixed with a separating agent.

Reference DE 44 24 920 A1 discloses a short inking unit which likewise serves for the inking of a waterless flat printing plate. In this case, a printing ink provided with a separating agent is applied to the form cylinder by a screen roller via two applicator rollers. One of the two applicator rollers is ink-carrying, while the other applicator roller is designed to be separating agent-friendly. High affinity to the separating agent is achieved by a coating having a silicone oil such, for example, as silicone rubber or fluorosilicone rubber.

Irrespective of whether a printing ink has to contain a separating agent in order to be particularly suitable for dry offset printing or whether printing is carried out using a dampening medium, there is the problem, particularly in the case of short inking units, of obtaining as smooth an ink film as possible on the form cylinder, in order to achieve high printing quality.

SUMMARY OF THE INVENTION

The object of the invention is to improve a printing unit of a rotary printing machine in such a way that an ink film of uniform thickness is obtained on a form cylinder.

This object is achieved by a smoothing cylinder applied to a form cylinder in a printing unit of a rotary printing machine or applied to an ink applicator roller, wherein an outer surface of the smoothing roller has an ink-repelling effect.

In a preferred embodiment, a transfer of printing ink onto the smoothing roller is prevented by appropriately designing the latter. The result of this, in particular, is that, in a nib between the form cylinder and the smoothing roller or between the ink applicator roller and smoothing roller, the ink film is merely squeezed and not split. Since the surface of the smoothing roller has an appropriately smooth design, the ink film thereby assumes a markedly more homogeneous structure, that is to say greater smoothness.

In a further embodiment, an improvement is obtained if the smoothing roller is not driven by friction with the ink applicator roller or form cylinder, but is provided with its own drive. The rolling conditions between the smoothing roller and ink applicator roller or form cylinder can thereby be improved for exerting an additional smoothing effect on the ink film. The ink-repelling effect of the smoothing roller may be achieved by coating the smoothing roller with a material which is coordinated with the printing ink used. In the case of waterless offset printing, this coating may include a silicone coating, such as is present in the print-free regions of the printing form.

The ink-repelling effect may also be achieved or assisted by applying a liquid to the smoothing roller during operation of the inking unit. In this case, the liquid thoroughly wets the smoothing roller and thus prevents ink from being applied to the latter. In wet offset printing, it is possible to use a liquid for the ink-repelling effect which has a composition similar to that of the dampening medium or is the dampening medium itself. In the case of dry offset printing, a silicone oil or an appropriate silicone oil substitute such, for example, as is mixed in the printing inks for waterless offset printing may be used.

Furthermore, the ink-repelling smoothing roller may, in the case of dry offset printing, comprise material or a coating having an affinity to silicon oils for absorbing the silicone oil fractions from the printing ink. The smoothing roller with this property forms a film which leads to a uniform ink film on the ink applicator roller or form cylinder. In addition, when the smoothing roller is applied onto an link applicator roller, the affinity of the smoothing roller to silicon oil causes the absorption of excess silicone oil and leads to a uniform distribution of the silicone oil fraction in the ink film. The silicone oil excess is absorbed by the smoothing roller and is redistributed to other regions of the ink applicator roller. The same likewise applies accordingly to the silicone oil substitute or when dampening medium has previously been mixed into the printing ink.

The smoothing roller is set axis-parallel to the ink applicator roller or the form cylinder, but may also be set obliquely, with the result that additional distribution of the printing ink layer occurs.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
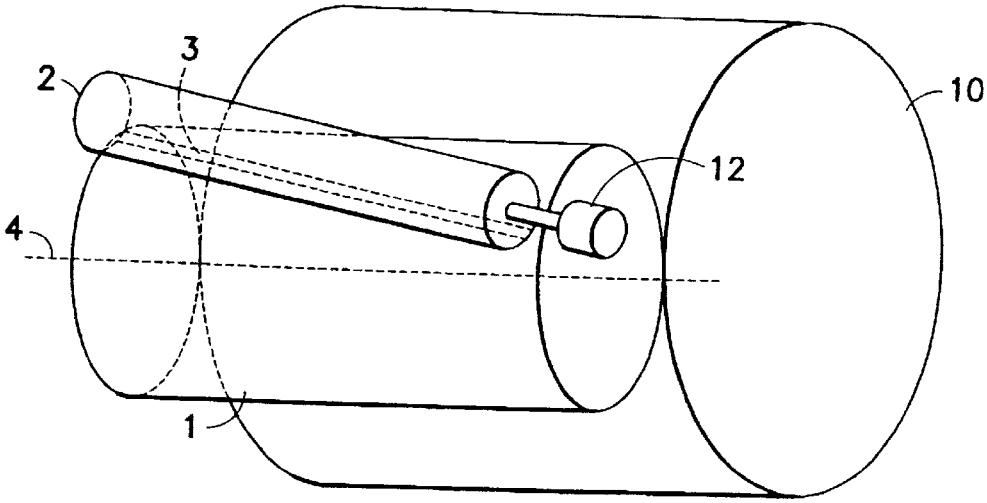
FIG. 1 shows an embodiment of a smoothing roller according to the present invention applied obliquely onto an ink applicator roller.
Figure 2:
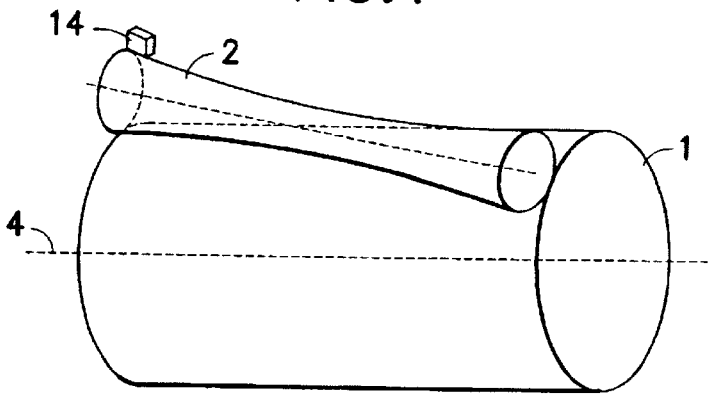
FIG. 2 shows another embodiment of a smoothing roller according to the present invention tapered at its center and applied obliquely onto an ink applicator roller.
Figure 3:
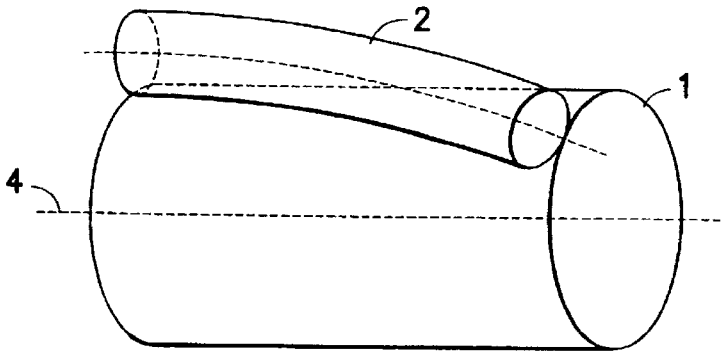
FIG. 3 shows another embodiment of the smoothing roller according to the present invention that is curved and applied onto an ink applicator roller.
Figure 1A:
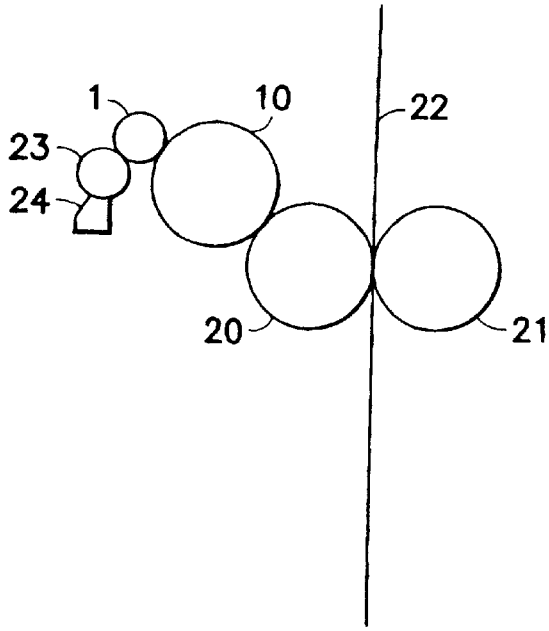
FIG 1*a* shows an ink applicator roller on a form roller in an offset printing machine.
Figure 1B:
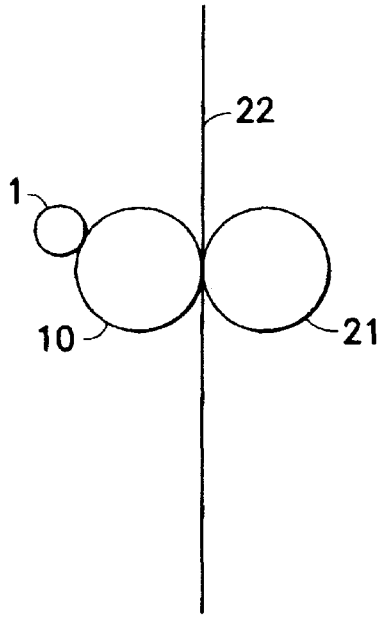
FIG. 1*b* shows an ink applicator roller on a form roller in a direct printing machine.
Figure 8:
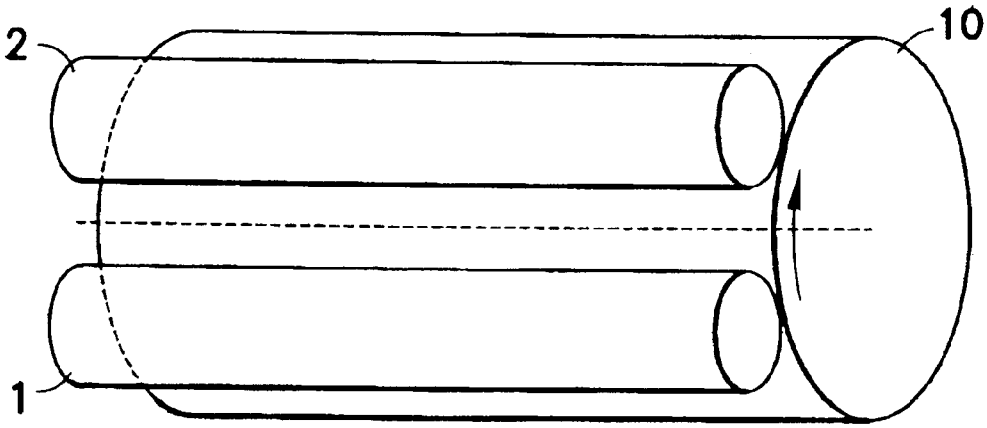
FIG. 8 shows an embodiment of a smoothing roller according to the present invention applied onto a form cylinder.

Referring to FIG. 1, an ink applicator roller 1 according to the present invention is arranged on a form roller 10 in an inking unit of a printing machine such, for example, as a short inking unit of an offset printing machine or a printing machine for direct printing. FIG. 1*a* shows an example of how the applicator roller 1 and the form roller 10 may be arranged in an offset printing machine. In this example, a transfer roller 20 such as, for example, a blanket roller, is arranged between the form roller 10 and an impression roller 21 for printing onto a web 22 which runs between the transfer roller 20 and the impression roller. FIG. 1*b* shows an example of how the applicator roller 1 and the form roller 10 may be arranged in a direct printing machine in which the form roller 10 directly contacts the web 22 for printing thereon. As shown in FIG. 1*a,* the ink applicator roller 1 is part of an inking unit such as, for example, a short inking unit comprising an ink transfer roller 23 and an ink supply 24. Although the printing machines in FIGS. 1*a* and 1*b* are depicted as roll fed rotary printing machines with vertical web trains, the ink applicator roller 1 and form roller 10 may be used in any type of rotary printing machine including sheet fed machines and rotary printing machines which do not have vertical web trains. A smoothing roller 2 designed as a rider roller is applied to the ink applicator roller 1 obliquely to the longitudinal axis of the ink applicator roller 1. Referring to FIG. 2, the smoothing roller may be concavely curved so that the diameter of the smoothing roller 2 toward its center is narrower than the diameter towards the sides thereof. Referring to FIG. 3, the smoothing roller 2 may be bent elastically about its longitudinal axis. For illustrative purposes, FIGS. 2 and 3 show exaggerated versions of the concavity and the bend of the longitudinal axis. The smoothing roller 2 may comprise a combination of the two measures illustrated in FIGS. 2 and 3. These measures ensure a contact surface 3 between the smoothing roller 2 and the ink applicator roller 1. The contact surface 3 has an equal width over its entire length. The contact surface 3 is produced because the smoothing roller 2 includes a hard or soft material, while the ink applicator roller 1 includes a soft elastic material such, for example, as rubber or foamed plastic. In another exemplary embodiment, the smoothing roller 2 is applied on the outer surface of the ink applicator roller 1 parallel to the longitudinal axis 4 of the latter. It is not absolutely necessary for the smoothing roller 2 to be applied obliquely. However, it proves advantageous if the smoothing roller 2 is applied obliquely. Since the surface of at least one of the ink applicator roller 1 and smoothing roller 2 is produced from an elastic material, contact occurs between them at the outer regions even when, as illustrated in FIG. 1, the smoothing roller 2 is not curved and not tapered in its center, provided that the smoothing roller 2 is set obliquely at only a small angle to the longitudinal axis 4 of the ink applicator roller 1. Instead of being applied to the ink roller 1, the smoothing roller 2 may be applied directly to the form cylinder 10 as illustrated in FIG. 8.

Referring again to FIG. 1, the smoothing roller 2 may have its own drive such, for example, as a motor 12, may be driven via a gearwheel connection by other cylinders, or may be driven by friction with the ink applicator roller 1 or the form cylinder 10. When the smoothing roller 2 rolls on the form cylinder 10, it absorbs silicone oil fractions, particularly a silicone oil excess from the ink/silicone layer of the form cylinder 10, and equalizes and distributes said silicone oil fractions.

A certain amount of slip between the smoothing roller 2 and the ink applicator roller 1 or form cylinder 10 is advantageous for achieving better smoothing of the ink film. When a positive drive such as the motor 12 is used to rotate the smoothing roller 2, the slip is achieved by presetting different circumferential speeds of the smoothing roller 2 and the ink applicator roller 1 or form cylinder 10. When the frictional drive is used to rotate the smoothing roller 2, a braking device 14 (shown schematically in FIG. 2) may be provided on the smoothing roller 2 so that the braking device generates the desired slip. Uniform distribution of the ink layer and, consequently, the smoothing of the latter are achieved as a result of the slip which is set in this way.

The smoothing roller 2, insofar as it is applied to the ink applicator roller 1, is designed as a rider roller. That is, the smoothing roller 2 does not touch other ink-transferring rollers.

Insofar as the smoothing roller 2 is applied to the form cylinder 10, it follows the ink applicator roller 1 in the direction of rotation of the form cylinder 10. In this case too, the smoothing roller 2 is designed as a rider roller.

The outer surface of the smoothing roller 2 preferably comprises an ink-repelling material. When the smoothing roller is used in a printing machine for dry offset printing, the outer surface comprises a material which has a high affinity to a separating agent. A material of this type may, for example, comprise silicone rubber or fluorosilicone rubber. The material which covers the printing plate for dry offset printing on its nonprinting regions may also be used for the surface of the smoothing roller 2. As an alternative or in addition to the surface coating, a separating agent may be supplied to the outer surface of the smoothing roller 2. The separating agent may comprise either a silicone oil or a silicone oil substitute, such as is mixed into printing inks for waterless offset printing. The separating agent wets the surface of the smoothing roller 2 sufficiently to ensure that ink is prevented from being transferred onto the smoothing roller 2. The ink-repelling smoothing roller 2 preferably absorbs from the printing ink the separating agent fractions which form a film on the printing ink, thus producing a particularly uniform ink film on the ink applicator roller 1 and a more uniform distribution of the separating agent fraction in the ink film on the ink applicator roller 1.

The smoothing roller 2 must also have an ink-repelling effect when the smoothing roller 2 is used in a printing process requiring a dampening medium. That is to say, the smoothing roller must be oleophobic. In addition, the dampening medium may be supplied to the outer surface of the smoothing roller 2 to assist the ink-repelling effect of the outer surface. In this case too, it is sufficient if the ink-repelling effect is achieved solely by supplying the dampening medium or a similar substance having an ink-repelling effect.

The separating agent or the dampening medium may be applied to the smoothing roller 2 from a fountain 5 (see FIGS. 4 to 7).

Figure 4:
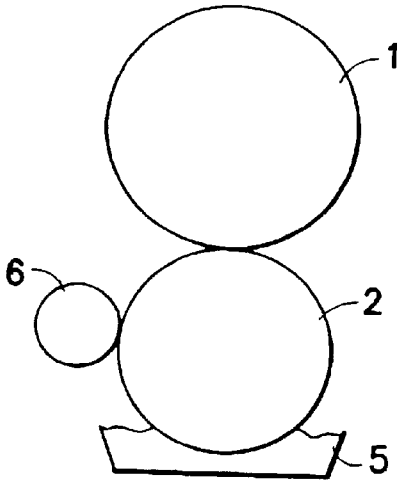
FIG. 4 shows an embodiment of the smoothing roller according to the present invention dipping into a fountain filled with a separating agent.

Referring specifically to FIG. 4, the smoothing roller 2 dips into the fountain 5 which is filled with the separating agent or the dampening medium. A squeezing roller 6 applied to the smoothing roller 2 equalizes the film formed on the outer surface of the smoothing roller 2 comprising the separating agent or the dampening medium. The squeezing roller 6 has, for example, a soft outer surface formed from an elastic material. If the smoothing roller 2 has a soft outer surface, the outer surface of the squeezing roller 6 may also comprise a hard material. The elasticity of the layer covering the outer surface of the smoothing roller 2 depends on whether the latter is applied to the form cylinder or to the ink applicator roller 1. If the smoothing roller 2 is applied to the form cylinder, it must have an outer surface comprising an elastic material such, for example, as rubber or elastic plastic. However, if the smoothing roller 2 is applied to the ink applicator roller 1, the outer surface of the smoothing roller 2 may comprise a hard material such, for example, as a hard rubber or a hard plastic, instead of the elastic material. The same applies accordingly to the squeezing roller 6. It is merely necessary always to avoid hard outer surface of rollers rolling on one another.

Figure 5:
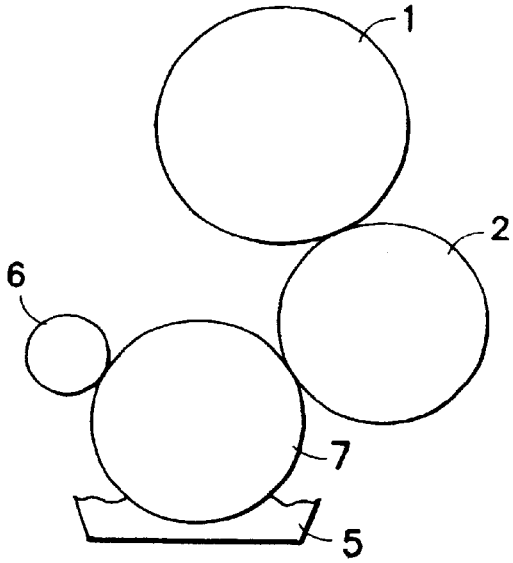
FIG. 5 shows an embodiment of a smoothing roller according to the present invention supplied with a separating agent via a dipping roller.

According to the embodiment of FIG. 5, the separating agent or the dampening medium is transferred from the fountain 5 to the smoothing roller 2 via a transfer roller 7, which dips into the fountain 5. In this case too, a squeezing roller 6 may also be provided, but it is not necessary.

Figure 6:
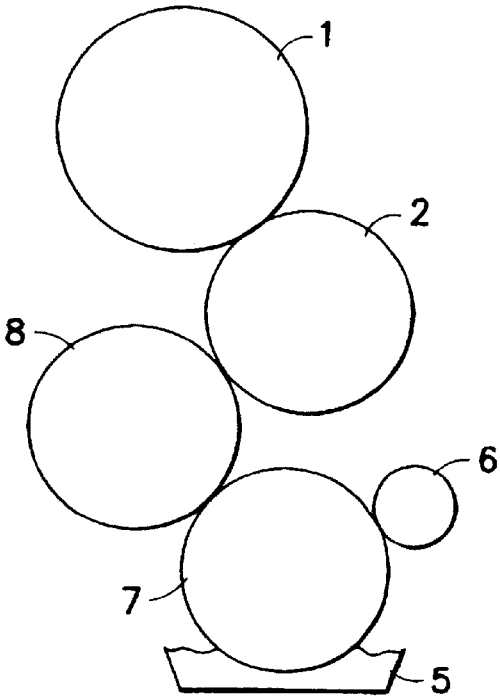
FIG. 6 shows an embodiment of a smoothing roller according to the present invention supplied with a separating agent via a dipping roller and a transfer roller.

According to a further embodiment shown in FIG. 6, another transfer roller 8 is interposed between the dipping roller 7 and the smoothing roller 2. In this case too, a squeezing roller 6 may be provided, which is preferably applied to the dipping roller 7. The transfer roller 8 may also be designed as a traversing roller. Instead of the dipping roller 7, a duct roller may also be provided, onto which a doctor blade is mounted, so that the dipping roller 7 is designed in the same way as an ink duct roller which rotates in an ink fountain of an inking unit.

Figure 7:
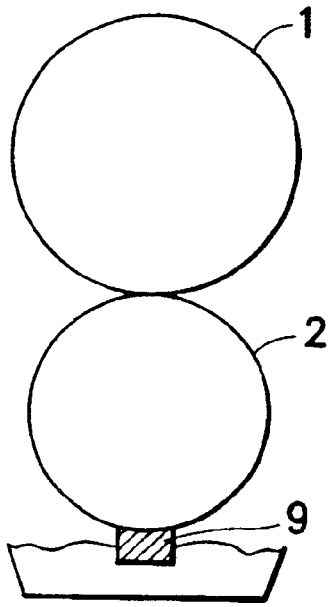
FIG. 7 shows an embodiment of a smoothing roller according to the present invention supplied with a separating agent via a felt block.

In a further exemplary embodiment shown in FIG. 7, a block 9 dipping into the separating agent in the fountain 5 and comprising a felt or a sponge material is saturated with the separating agent or the dampening medium and discharges onto the outer surface of the smoothing roller 2.

Referring now to FIG. 8, the smoothing roller 2 is applied to the form cylinder 10 directly. The smoothing roller 2 is arranged downstream of the ink applicator roller 1 relative to the direction of rotation of the form cylinder 10.

When the smoothing roller is used in a printing process for wet offset printing, a connection from the fountain 5 for supplying the smoothing roller 2 with the dampening medium may also be provided for monitoring, for example, by means of a filling level sensor monitor, whether an intended quantity of dampening medium is constantly present in the fountain 5.

Instead of the single transfer roller 8 according to FIG. 6, a plurality of transfer rollers may also be provided, one or more being designed as traversing rollers.

The smoothing roller 2 may also be used in printing units for direct printing. A plurality of smoothing rollers 2 may also be applied to the ink applicator roller 1 or onto the form cylinder 10.

If the smoothing roller 2 is used in a printing process employing a dampening medium, the dampening medium for wetting the surface of the smoothing roller 2 may also be supplied by preemulsifying the printing ink, with which the smoothing roller 2 comes into contact on the outer surface of the ink applicator roller 1, with the dampening medium. In this embodiment, the printing ink already contains the dampening medium so that no separate supply of the dampening medium is required.

The present invention provides a smoothing roller 2 for a printing unit of a rotary printing machine. The smoothing roller 2 is applied to either the form cylinder 10 downstream of the ink applicator roller 1 in relation to the direction of rotation of the form cylinder 10 or to the ink applicator roller 1 itself. The smoothing roller 2 smooths the ink film on the form cylinder 10 or on the ink applicator roller 1. The outer surface of the smoothing roller 2 has an ink-repelling effect. The ink-repelling effect of the smoothing roller 2 is achieved in that an ink-repelling material, which may comprise a separating agent or a dampening medium, is applied to the outer surface of the smoothing roller 2, or in that the smoothing roller 2 has an outer surface comprising an ink-repelling material. These two measures may also be provided in combination with one another.

The invention is not limited by the embodiments described above which are presented as examples only but can be modified in various ways within the scope of protection defined by the appended patent claims.

We claim:

1. In a printing unit of a rotary printing machine, a combination comprising a rotatably mounted form cylinder, an ink applicator roller applied to said form cylinder and a smoothing roller applied to said ink applicator roller and operatively arranged for smoothing an ink film on said form cylinder, said smoothing cylinder comprising a smooth outer surface having an ink repelling characteristic and forming a nib between said ink applicator roller and said smoothing cylinder for smoothing the ink film on said ink applicator roller by squeezing the ink film on said ink applicator roller and preventing transfer of printing ink onto the smoothing roller.

2. The combination of claim 1, wherein said outer surface of said smoothing roller comprises an ink-repelling material.

3. The combination of claim 2, wherein said ink-repelling material comprises one of a silicone rubber and a fluorosilicone rubber.

4. The combination of claim 1, wherein said outer surface of said smoothing roller is wetted by an ink-repelling liquid comprising one of a silicone oil and a silicone oil substitute and said outer surface of said smoothing roller contacts said ink-repelling liquid.

5. The combination of claim 4, wherein said ink-repelling liquid is mixed into said printing ink.

6. The combination of claim 1, wherein said smoothing roller comprises one of a positive drive and a friction drive via one of the form cylinder or the ink applicator roller; and said smoothing roller has a slip relative to the one of the form cylinder and the ink applicator roller.

7. The combination of claim 1, wherein said smoothing roller is arranged one of axis-parallel and oblique to said ink applicator roller.

* * * * *